US006273315B1

(12) United States Patent
McGuinness et al.

(10) Patent No.: US 6,273,315 B1
(45) Date of Patent: Aug. 14, 2001

(54) TIN TAG DISPENSING MEANS FOR ROOFING GUNS, AND CARTRIDGES

(76) Inventors: Thomas J. McGuinness, 1208 Mohican Blvd., Jupiter, FL (US) 33458; James M. McGuinness, 2327 Camino Rancho Siringo, Santa Fe, NM (US) 87505

( * ) Notice: Subject to any disclaimer, the term of this patent is extended or adjusted under 35 U.S.C. 154(b) by 0 days.

(21) Appl. No.: 09/495,893

(22) Filed: Feb. 2, 2000

(51) Int. Cl.[7] ..... B25C 7/00

(52) U.S. Cl. ..... 227/18; 227/119; 227/120; 227/138; 206/445; 221/197

(58) Field of Search ..... 227/18, 15, 120, 227/99, 100, 136, 135; 206/445, 303; 221/197, 198, 297, 289

(56) References Cited

U.S. PATENT DOCUMENTS

| | | | | |
|---|---|---|---|---|
| 1,838,797 | * | 12/1931 | Towy | 206/445 |
| 2,520,321 | * | 8/1950 | McDonald et al. | 221/289 |
| 3,362,530 | * | 1/1968 | Johnson | 206/445 |
| 3,480,192 | * | 11/1969 | Scurlock et al. | 227/120 |
| 3,595,460 | * | 7/1971 | Pitkin | 227/120 |
| 3,998,238 | * | 12/1976 | Nigro | 221/297 |
| 5,042,142 | * | 8/1991 | Beach et al. | 227/120 |
| 5,056,684 | * | 10/1991 | Beach et al. | 227/120 |
| 5,163,580 | * | 11/1992 | Beach et al. | 221/197 |
| 5,501,387 | * | 3/1996 | Yoshie | 227/120 |
| 5,634,583 | | 6/1997 | McGuinness et al. . | |
| 5,673,816 | * | 10/1997 | Larson et al. | 221/197 |
| 5,791,546 | | 8/1998 | McGuinness et al. . | |
| 5,865,341 | * | 2/1999 | Martin | 221/197 |

* cited by examiner

*Primary Examiner*—Scott A. Smith
(74) *Attorney, Agent, or Firm*—Laubscher & Laubscher

(57) ABSTRACT

A tin tag dispensing attachment for roofing guns and the like includes a housing containing a chamber for receiving a cylindrical cartridge containing a stack of disk-shaped tin tags. The cartridge includes a vertical tubular resilient wall containing a longitudinal slit running the length thereof, the bottom end of the cartridge being expandable by an expansion device carried by the housing, thereby to release the tin tag stack for longitudinal displacement relative to the cartridge wall from a supported position to a released position, whereupon the lowermost tin tag of the released stack is positioned for displacement from the tag feeding station to the tag nailing station.

20 Claims, 4 Drawing Sheets

TIN TAG DISPENSING MEANS FOR ROOFING GUNS, AND CARTRIDGES

SPECIFICATION

BACKGROUND OF THE INVENTION

1. Field of the Invention

An attachment for feeding tin tags from a cartridge to a nailing gun is disclosed, including means for radially expanding the longitudinally-split cartridge wall to release the stack of cartridges contained therein, whereby successive tin tags may be fed from the bottom of the stack from the tin tag dispensing station to the nailing station.

2. Brief Description of the Prior Art

Tin tag dispensing attachments for nailing guns are well known in the patented prior art, as evidenced by the earlier McGuinness U.S. pat. Nos. 5,634,583 and 5,791,546. In these prior tin tag dispensing systems, the attachment systems serve to automatically displace successive tin tags from the bottom of a stack to a nailing station relative to the nailing gun to which the devices are attached.

In the aforementioned McGuinness, et al., U.S. pat. No. 5,791,546, the use of tin tag cartridge means has been proposed for supplying the tin tags to the attachment.

The present invention was developed to provide an improved tin tag cartridge which is readily inserted into, and easily removed from, the working chamber of the tin tag dispensing housing that is attached to the gun. The invention provides an inexpensive and positive way for supplying a stack of tin tags to the loading station of the attachment.

SUMMARY OF THE INVENTION

Accordingly, a primary object of the present invention is to provide a nailing gun attachment having a housing containing a dispensing chamber for receiving a tin tag cartridge including a resilient longitudinally split cartridge wall within which is supported a stack of tin tags, expansion means being provided on the housing for radially expanding the bottom portion of the cartridge wall, thereby to release the stack of tin tags contained therein.

According to a more specific object of the invention, the expansion means comprises an annular upwardly directed pointed edge having an internal diameter which is greater than the diameter of the tin tags, but less than the inner diameter of the tubular cartridge wall. Spring biasing means bias the cartridge longitudinally downwardly toward the pointed edge, thereby to expand the cartridge wall radially outwardly to release the stack of tin tags supported therein.

A further object of the invention is to provide a sectional housing including a cover section that is outwardly pivotable toward an open loading position at which a cartridge carrying a stack of tin tags may be loaded thereon. After the cover means is returned to the closed position and thereby introduce the tin tag cartridge into the housing chamber, latching means are operable to lock the cover section in the closed position. Spring means initially bias the cartridge and tin tag stack downwardly forward the cartridge wall expansion means, and following expansion of the cartridge, subsequently bias the stack downwardly relative to the cartridge wall toward the tin tag loading station arranged therebelow.

BRIEF DESCRIPTION OF THE DRAWINGS

Other advantages and objects of the invention will become apparent from a study of the following specification when viewed in the light of the accompanying drawings, in which.

DETAILED DESCRIPTION

Figures 1, 8, 9:
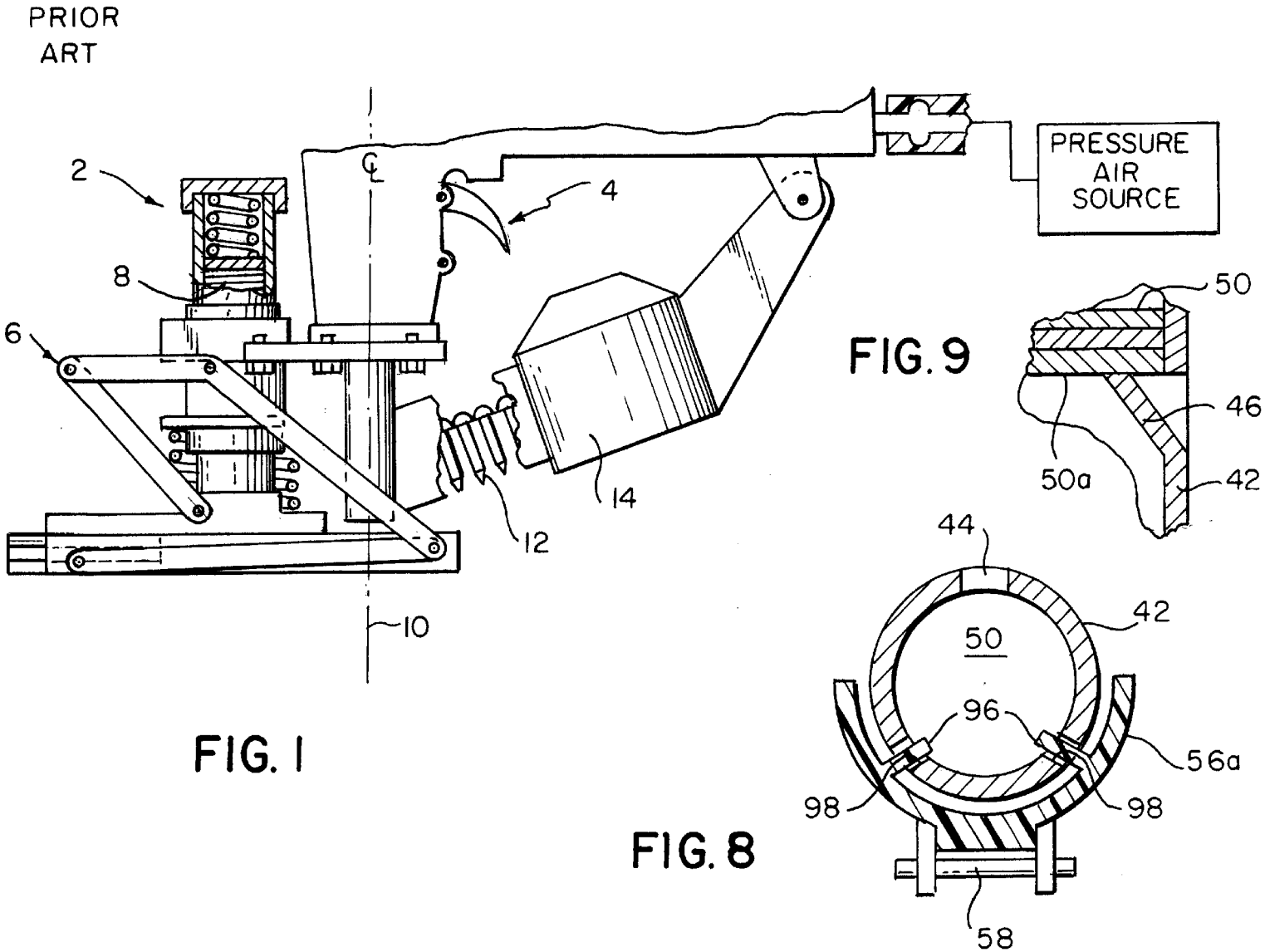
FIG. 1 is an elevation view of the prior art tin tag attachment for roofing guns shown in the aforementioned McGuinness, et al., U.S. pat. No. 5,634,583.
FIG. 8 is a sectional view taken along line 8—8 of FIG. 3.
FIG. 9 is a detailed sectional view of the punched out support ledge on the internal surface of the tubular cartridge wall.
Figures 2, 5, 6, 7:
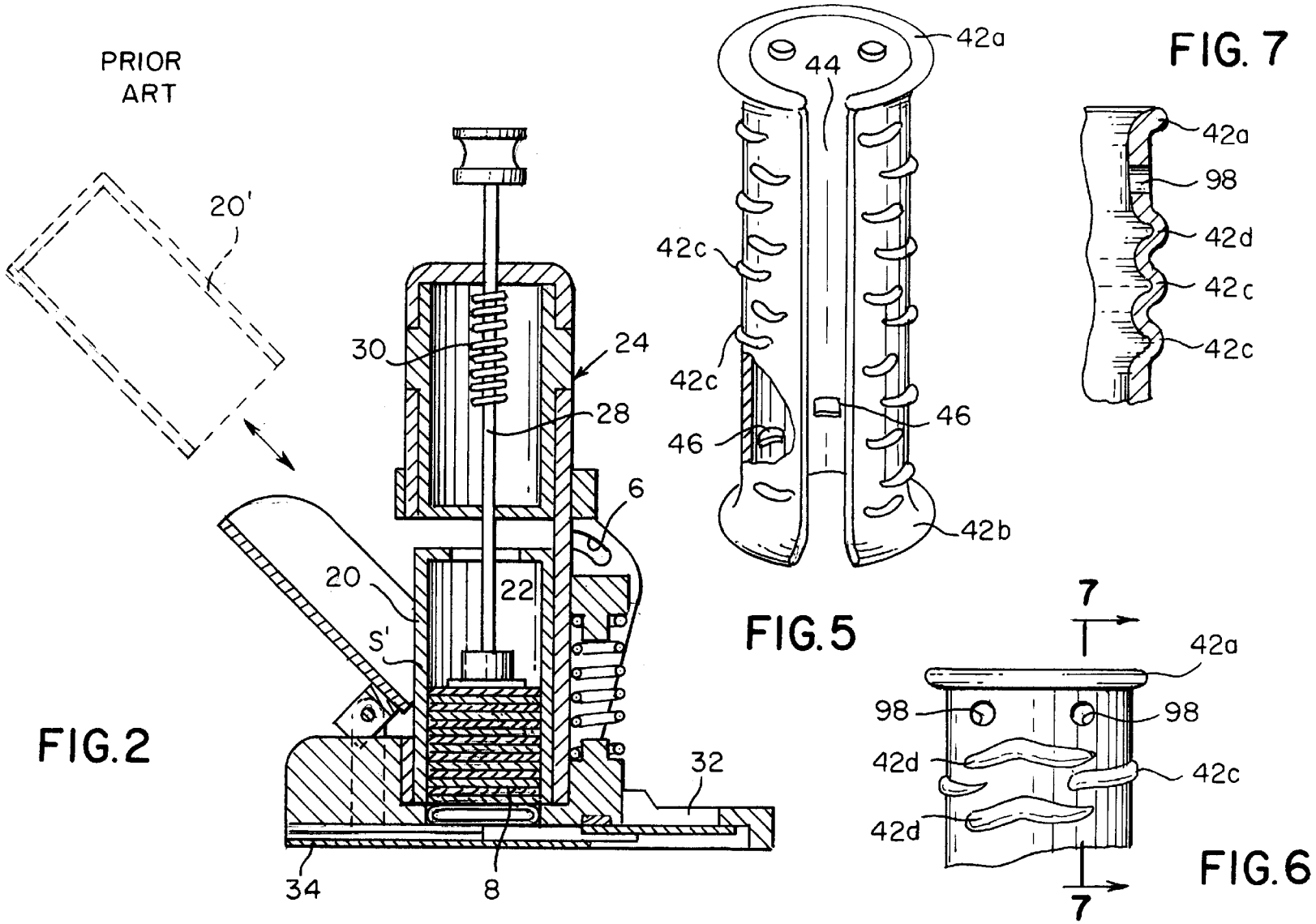
FIG. 2 is a sectional view illustrating the tin tag attachment of the prior art shown in the McGuinness, et al., U.S. pat. No. 5,791,546.
FIG. 5 is a front perspective view of the cartridge wall.
FIG. 6 is a detailed rear view of the top portion of the cartridge wall.
FIG. 7 is a sectional view taken along line 7—7 of FIG. 6.

Referring first more particularly to FIGS. 1 and 2, the prior tin tag attachment means 2 are adapted for use with conventional nailing guns 4 and include linkage means 6 that are operable to displace tin tags 8 in succession from the bottom of a stack thereof from a loading position toward a nailing station 10 opposite the location at which the nails 12 are supplied from the magazine 14 of the nailing gun. As shown in FIG. 2, the tin tags 8 may be supplied from a tin tag cartridge 20 that is introduced within the chamber 22 of the housing 24 via the opening defined by housing cover member 26. Thus, when the cover 26 is closed, the stack S is biased downwardly by the pusher rod 28 and spring biasing means 30. Successive tin tags 8 are supplied from the bottom of the stack to the nailing station 32 by the slide member 34 that is operable by the linkage means 6.

Figure 3:
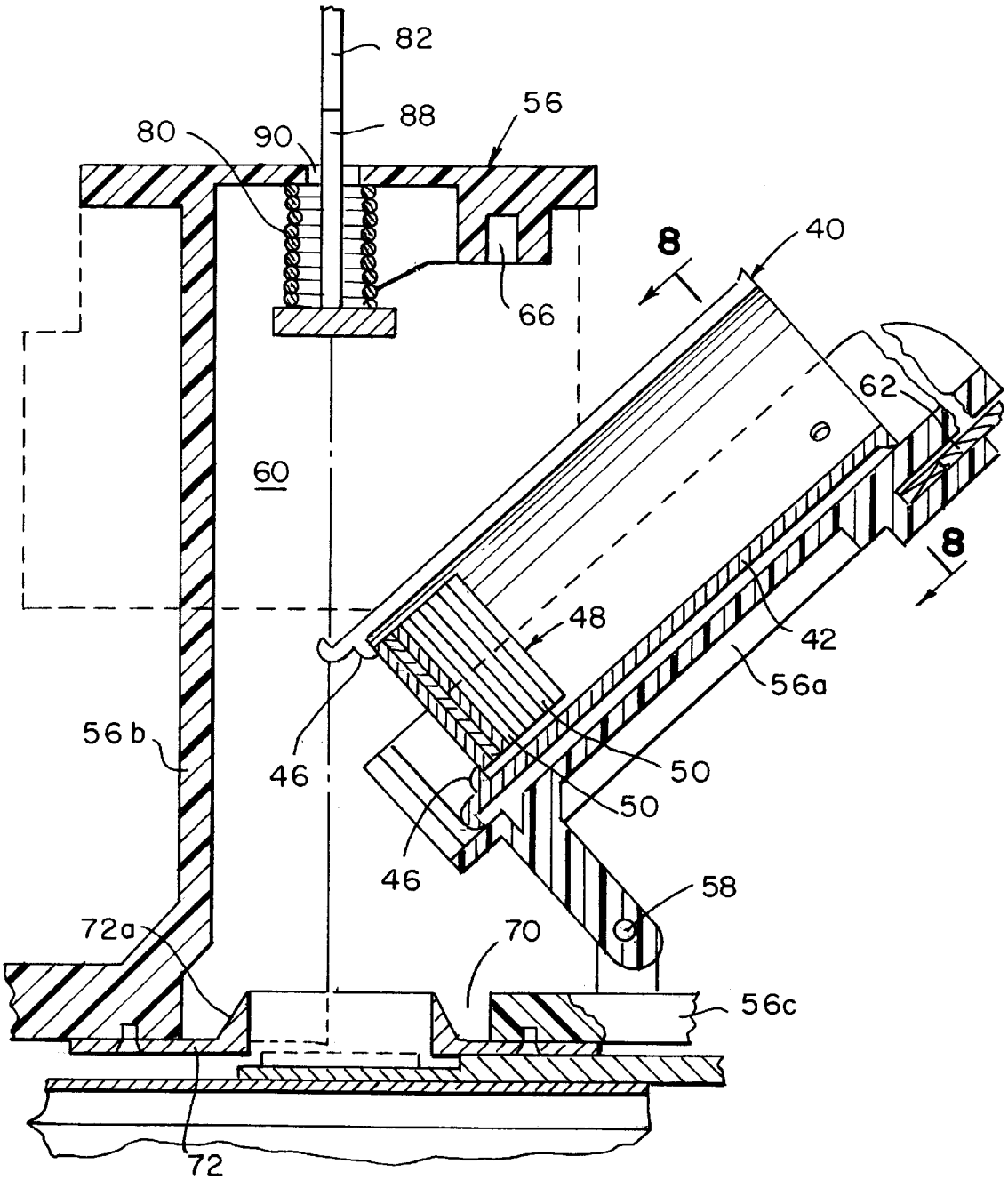
FIG. 3 is a sectional view of the tin tag attachment of the present invention with the cover section of the housing in the open position and with the tin tag cartridge mounted thereon.
Figure 4:
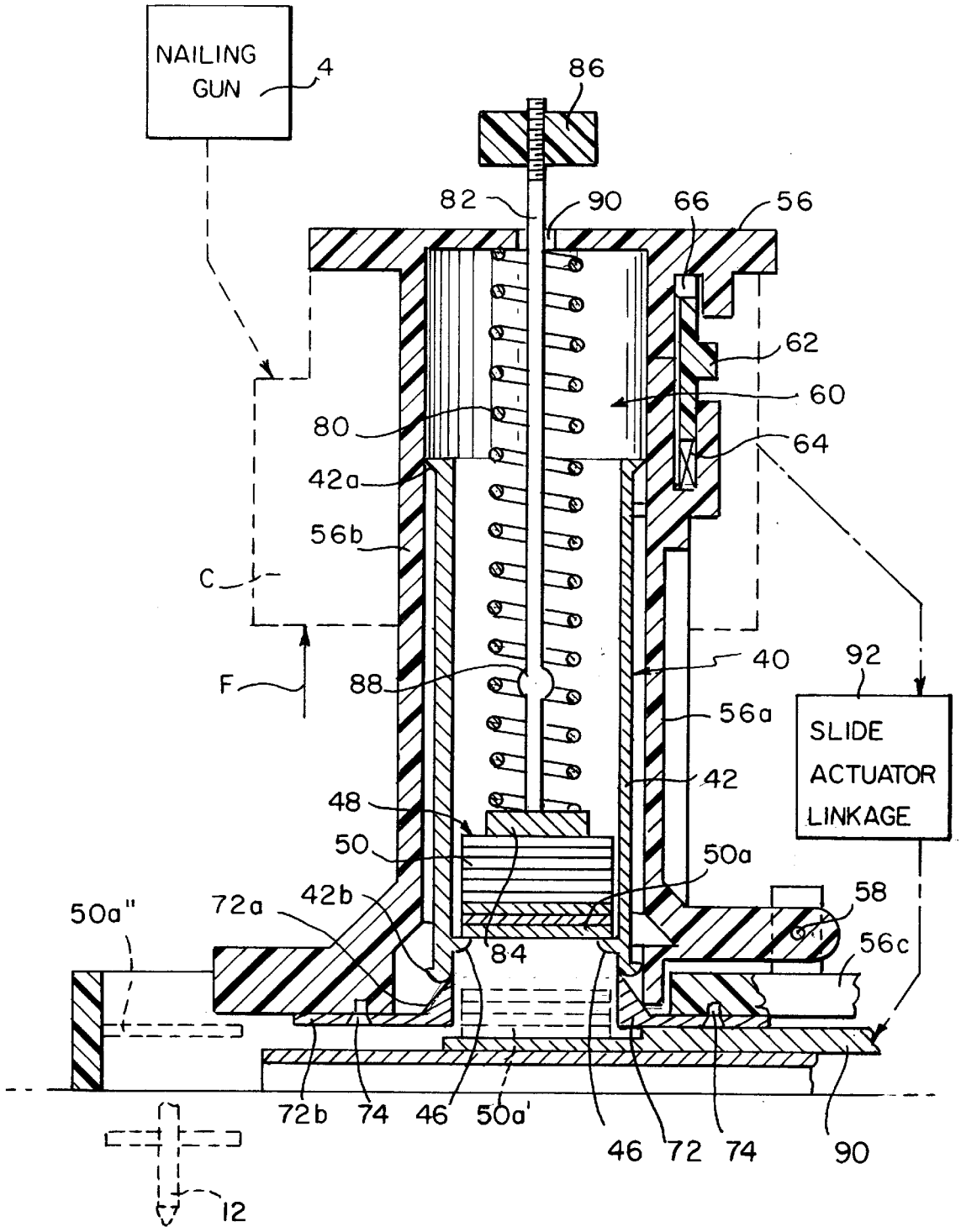
FIG. 4 illustrates the attachment with the cover member pivoted to the locked closed position, and with the cartridge arranged in the housing chamber prior to the radial expansion of the longitudinally split cartridge wall.

Referring now to FIGS. 3 and 4, according to the present invention, a novel tin tag cartridge 40 is provided which includes a tubular wall member 42 that is longitudinally split throughout its length to define a slot 44, as best shown in FIG. 5. As will be described in greater detail below, the tubular wall 42 is formed of a resilient material such as spring steel, and is provided at its lower end with a plurality of circumferentially spaced inwardly directed ledge projections 46 that support a stack 48 of circular disk-shaped circular tin tags 50. The cover section 56*a* is connected to the main body section 56*b* of the housing 56 by the pivot means 58 that in turn is supported by the base portion 56*c* of the housing 56. The cover section 56*a* is pivotally movable from the open position of FIG. 3 toward the closed position of FIG. 4 at which the cover sections cooperate to define the cartridge chamber 60. The cover section 56*a* is locked in the closed position of FIG. 4 by means of a latch member 62 that is biased by spring 64 toward the locked position in which the extremity of the latch 62 extends within corresponding recess 66 contained in the upper portion of the housing section 56*b*.

As shown in FIG. 3, the base portion 56*c* of the housing 56 contains a first opening 70 in which is mounted the expansion member 72 having a sharp annular edge portion 72*a* that extends upwardly concentrically within the first through bore 70. The annular extension edge 72*a* is carried by a plate portion 72*b* that is fastened to the bottom surface of the base portion 56*c* by the fastener devices 74. The inner surface of the expansion edge 72*a* is vertical and has a diameter that is slightly larger than the diameter of the tin tags 50, but slightly smaller than the internal diameter of the tubular cartridge wall 42.

As best shown in FIGS. 5—7, the upper and lower extremities 42*a* and 42*b* of the cartridge wall are flared slightly outwardly. The tubular cartridge wall 42 is provided with a plurality of circumferentially spaced rib portions 42*c* that are formed by depressions in a wall, as best shown in FIG. 7. The side wall opposite the through slot 44 is provided with generally V-shaped supporting rib portions 42*d*, as best shown in FIG. 6.

Referring now to FIG. 4, the cartridge 40 containing the stack 48 of tin tags 50 is normally biased downwardly relative to the housing 56 by compression spring 80 that is mounted concentrically about the push rod 82. At its lower end, the push rod 82 supports a push member 84 that engages the top tin tag of the stack 48, and at its upper end, the push rod is provided with a threadably connected knob 86. Adjacent its lower end, the push rod 82 is provided with an enlargement 88 that is adapted for displacement through the slot 90 contained in the upper end of the housing 56. Thus, when the push rod is displaced vertically upwardly to the retracted position shown in FIG. 3, the helical spring 80 is compressed between the push portion 84 and the upper end of the housing chamber 60. Upon rotation of the shaft 82 to a position normal to the access of the slot 90, the push rod 82 is locked in its uppermost position, as shown in FIG. 3.

In accordance with a characterizing feature of the present invention, when the chamber section 56*a* carrying the tin tag cartridge 40 is pivoted from the open position of FIG. 3 toward the closed position of FIG. 4, and when the pusher rod 82 is rotated 90 degrees to the released position of FIG. 4, the compression spring 80 biases the push member 84 downwardly to bias the tin tag stack 48 and the cartridge wall 42 downwardly relative to the upwardly directed edge portion 72*a* of expansion means 72. Owing to the outwardly inclined surfaces of the expansion edge 72*a*, the lower end portion of the tubular cartridge wall 42 is expanded radially outwardly, whereupon the support ledges wall are displaced outwardly from beneath the lowermost tin tag 50*a*, whereupon the tin tag stack 48 is free for downward displacement toward the tin tag dispensing position shown in phantom in FIG. 4. The nailing gun 4 may be displaced downwardly relative to the base portion 56*c*, whereupon the vertically shiftable operating collar C attached to the nailing gun is displaced downwardly by the user against the restoring force of spring means F, thereby to displace the tin tag feeding member 90 to the left by means of the slide actuator linkage 92. The tin tag is then displaced to the nailing position 50*a*" shown in phantom, whereupon the nailing gun is actuated to shoot the nail 12 through the tin tag.

Referring now to FIGS. 3 and 8, in order to retain the cartridge 40 on the cover section 56*a* when the cover section is in the open position, the internal surface of the upper portion of the cover section is provided with a pair of radially inwardly projecting locator pins 96, which pins extend through corresponding locator openings 98 contained in the upper portion of the tubular cartridge wall 42. The locator openings 98 are so arranged that the longitudinal slot 44 is diametrically opposite the side of the tubular cartridge wall 42 that is adjacent the pivot access 58 of the cover section 56*a*.

Referring to FIG. 9, the ledge support 46 is partially punched inwardly from the tubular wall 42, thereby to engage the outer peripheral portion of the lower most tin tag 50*a* of the stack 48.

While in accordance with the provisions of the patent Statutes, the preferred forms and embodiments of the invention have been illustrated and described, it will be apparent to those skilled in the art that various changes may be made without deviating from the inventive concepts set forth above.

What is claimed is:

1. An attachment for supplying a succession of circular tin tags to the nailing axis of a nailing gun, comprising:

(a) a housing (56) adapted for connection with a nailing gun adjacent the nailing axis thereof, said housing including a horizontal base portion containing a vertical first circular through bore (70) defining a tag feeding station, said housing containing a cartridge chamber (60) arranged vertically above said first through bore;

(b) cylindrical tin tag cartridge means having a longitudinal axis and including:

(1) a cylindrical stack (48) of circular tin tags each having a given diameter;

(2) a vertical tubular resilient cartridge wall (40) having upper and lower edges, said cartridge wall containing throughout the length thereof a longitudinal slit, said cartridge wall having an internal diameter that is at least as great as the tin tag diameter; and (3) support means (46) for initially supporting said tin tag stack vertically within said cartridge wall in vertically spaced relation relative to said cartridge wall lower edge, the lowermost tin tag of said stack including a bottom surface having a peripheral edge portion, said support means being integral with the interior surface of said cartridge wall and extending radially inwardly for supporting engagement with the peripheral edge portion of the bottom surface of the lowermost tin tag of the stack;

(c) means (56*a*) for mounting said tin tag cartridge means vertically within said cartridge chamber above said through bore; and (d) expansion means (72) for radially expanding the lower edge portion of said cartridge wall to displace said support means outwardly from beneath the peripheral edge portion of the lowermost tin tag, thereby to release said stack for downward displacement toward said first through bore.

2. Apparatus as defined in claim 1, and further including spring means biasing said tin tag stack downwardly within said cartridge wall toward said first through bore.

3. Apparatus as defined in claim 2, wherein said chamber is cylindrical; and further wherein said housing is sectional and includes a body section connected with said base, and a cover section movably connected with said body section, said body and cover sections each carrying a portion of the wall of said cartridge chamber.

4. Apparatus as defined in claim 3, wherein said body and cover sections carry opposed longitudinally-split semicircular halves of said cartridge chamber wall.

5. Apparatus as defined in claim 4, wherein said cover section is pivotally connected with said body section for pivotal movement between open and closed positions relative to said body section.

6. Apparatus as defined in claim 5, and further including releasable locking means operable when said cover section is in the closed position for locking said cover section to said body section.

7. Apparatus as defined in claim 6, wherein said releasable locking means includes spring biased latch means.

8. Apparatus as defined in claim 5, and further including mounting means for mounting said cartridge means on said cover section.

9. Apparatus as defined in claim 8, wherein said mounting means includes at least one radically inwardly extending locator pin carried by the chamber wall portion of said cover member, said cartridge wall member containing a locator opening for receiving said locator pin.

10. Apparatus as defined in claim 9, wherein said locator pin and said locator opening are so arranged that when said cartridge means is mounted on said cover section, said longitudinal slit is on the side of said cartridge wall that is remote from, and diametrically opposite, the pivot axis of said cover section.

11. Apparatus as defined in claim 3, wherein the lower edge portion of said cartridge wall is flared radially outwardly for cooperation with the external surface of said annular sharp edge portion of said expansion means.

12. Apparatus as defined in claim 2, wherein said expansion means comprises an annular expansion member mounted concentrically within said first through bore, said annular expansion member including an upwardly projecting annular sharp edge portion the internal diameter of which is slightly greater than the tin tag diameter and which is slightly less than the normal internal diameter of said cartridge wall, the outer circumferential surface of said sharp edge portion having an upwardly convergent conical configuration, whereby when said cartridge means is introduced within said chamber, the downward biasing force of said spring means on said cartridge means causes the lower portion of said cartridge wall to be expanded by said annular sharp edge portion, thereby to release said tin tag stack.

13. Apparatus as defined in claim 1, wherein said cartridge wall contains a plurality of circumferentially extending spaced strengthening ribs.

14. Apparatus as defined in claim 1, wherein said support means includes a plurality of circumferentially spaced inwardly punched ledge projections adjacent and upwardly spaced from the lower edge of said cartridge wall.

15. A tin tag cartridge for supplying tin tags to a nailing gun, comprising:

(a) a vertical resilient tubular cartridge wall having upper and lower edges, said cartridge wall containing throughout its length a longitudinal slit;

(b) a stack of circular tin tags having a given diameter, the lowermost tin tag of said stack including a bottom surface having a peripheral edge portion; and (c) support means for supporting said tin tag stack within said cartridge wall in vertically spaced relation relative to said cartridge wall lower edge, said support means being integral with the internal surface of said cartridge wall and extending inwardly for engagement solely with the bottom peripheral edge portion of the lowermost tin tag of the stack, the bottom edge portion of said tubular cartridge wall being radially outwardly expandable to displace said support means from the supporting position beneath the stack, thereby to release said tin tag stack for downward displacement relative to said cartridge wall.

16. A tin tag cartridge as defined in claim 15, wherein the bottom edge of said cartridge wall is flared radially outwardly for cooperation with an annular expansion edge member.

17. A tin tag cartridge as defined in claim 15, wherein said cartridge wall contains throughout its length a plurality of spaced circumferentially extending strengthening ribs.

18. A tin tag cartridge as defined in claim 17, wherein said support means includes a plurality of integral radially inwardly punched circumferentially spaced ledge projections on said cartridge wall adjacent and spaced from the lower edge of said cartridge wall.

19. A tin tag cartridge as defined in claim 18, wherein said cartridge wall contains adjacent its upper edge at least one locator opening for receiving a locator pin to orient the tin tag cartridge relative to a holder therefor.

20. A tin tag cartridge as defined in claim 19, wherein the upper edge portion of said cartridge wall is radially outwardly flared.

* * * * *